US012092407B2

(12) United States Patent
Choi et al.

(10) Patent No.: US 12,092,407 B2
(45) Date of Patent: Sep. 17, 2024

(54) INTEGRATED HEAT EXCHANGER

(71) Applicant: Hanon Systems, Daejeon (KR)

(72) Inventors: Jungbum Choi, Daejeon (KR); Gwang Ok Ko, Daejeon (KR); Byoung Sun Cho, Daejeon (KR); Ji Hun Han, Daejeon (KR)

(73) Assignee: Hanon Systems, Daejeon (KR)

( * ) Notice: Subject to any disclaimer, the term of this patent is extended or adjusted under 35 U.S.C. 154(b) by 448 days.

(21) Appl. No.: 16/646,649

(22) PCT Filed: Sep. 13, 2018

(86) PCT No.: PCT/KR2018/010765
§ 371 (c)(1),
(2) Date: Mar. 12, 2020

(87) PCT Pub. No.: WO2019/054774
PCT Pub. Date: Mar. 21, 2019

(65) Prior Publication Data

US 2020/0271398 A1 Aug. 27, 2020

(30) Foreign Application Priority Data

Sep. 15, 2017 (KR) ..... 10-2017-0118654
Sep. 22, 2017 (KR) ..... 10-2017-0122200

(51) Int. Cl.
*F28F 9/02* (2006.01)
*F28D 1/053* (2006.01)

(52) U.S. Cl.
CPC ..... *F28F 9/0226* (2013.01); *F28D 1/05366* (2013.01)

(58) Field of Classification Search
CPC ..... F28F 9/0219; F28F 9/0224; F28F 9/0226; F28F 2270/02; F28D 1/05366
See application file for complete search history.

(56) References Cited

U.S. PATENT DOCUMENTS 5,979,546 A 11/1999 Stolarski et al.
8,910,704 B2 * 12/2014 Mizuno ..... F28F 9/0209 165/173

(Continued)

FOREIGN PATENT DOCUMENTS

DE 102010050555 A1 7/2011
DE 102013227113 A1 7/2015

(Continued)

OTHER PUBLICATIONS

Office Action issued in corresponding German Patent Application No. 11 2018 005 158.7 on Jul. 27, 2021.

(Continued)

*Primary Examiner* — Tavia Sullens
*Assistant Examiner* — Khaled Ahmed Ali Al Samiri
(74) *Attorney, Agent, or Firm* — Norton Rose Fulbright US LLP; James R. Crawford

(57) ABSTRACT

An integrated heat exchanger in which a flow path, in which a first heat exchange medium flows, and a flow path, in which a second heat exchange medium flues, are separated by a baffle, and includes a support surface having a slope of which the height lowers toward the outside, and formed at a header portion coming in contact with a gasket baffle sealing part, and the gasket baffle sealing part formed in a shape corresponding to the support surface of a header such that the deformation of a gasket is prevented during coupling; and problems in which the gasket of a coupling part, at which the baffle is positioned, is non-uniformly compressed or the gasket is broken or separated from a designated position by means of force of the other direction is prevented.

12 Claims, 9 Drawing Sheets

(56) References Cited

U.S. PATENT DOCUMENTS

| | | | | |
|---|---|---|---|---|
| 9,057,566 | B2 * | 6/2015 | Lesueur | F28F 9/0226 |
| 2008/0047687 | A1 | 2/2008 | Leitch et al. | |
| 2011/0120671 | A1 | 5/2011 | Brauning et al. | |
| 2013/0299149 | A1 | 11/2013 | Riondet et al. | |

FOREIGN PATENT DOCUMENTS

| | | | |
|---|---|---|---|
| EP | 3115723 | A1 | 1/2017 |
| FR | 2913477 | A1 | 9/2008 |
| JP | H05-272889 | A | 10/1993 |
| JP | H09-269199 | A | 10/1997 |
| JP | H10-267588 | A | 10/1998 |
| JP | 2000249492 | A | 9/2000 |
| JP | 2002115991 | A | 4/2002 |
| JP | 2011099631 | A | 5/2011 |
| JP | 2012215366 | A | 11/2012 |
| JP | 2014-055736 | A | 3/2014 |
| JP | 2016017722 | A | 2/2016 |
| JP | 2016102623 | A | 6/2016 |
| KR | 20000001041 | A | 1/2000 |

OTHER PUBLICATIONS

Office Action issued in corresponding Chinese Patent Application No. 201880067139.4 on Feb. 16, 2022.

* cited by examiner

INTEGRATED HEAT EXCHANGER

This application is a national phase under 35 U.S.C. § 371 of International Application No. PCT/KR2018/010765 filed on Sep. 13, 2018, which claims the benefit of priority from Korean Patent Application Nos. 10-2017-0118654 filed on Sep. 15, 2017, and 10-2017-0122200 filed on Sep. 22, 2017. The entire contents of each of these applications is incorporated herein by reference in its entirety.

TECHNICAL FIELD

The present invention relates to a heat exchanger, and more particularly to an integrated heat exchanger in which a flow path through which a first heat exchange medium flows and a flow path through which a second heat exchange medium flows are separated by a baffle.

BACKGROUND ART

Heat exchangers having individual coolant flow paths in a single radiator to improve heat exchange performance of the radiator have been actively studied and, for example, radiators such as a U-flow type radiator 10*a* in which a flow path through which a coolant is introduced and a flow path through which the coolant is discharged are separated from each other as shown on FIG. 1A or a low temperature/high temperature integrated type radiator 10*b* in which coolants having different temperatures have individual flow paths as shown on FIG. 1B have been developed.

A header tank 11 of the U-flow type radiator 10*a* or the low temperature/high temperature integrated type radiator 10*b* includes a tank 12 in which a flow path through which a refrigerant is introduced and a flow path through which the refrigerant is discharged are separated by a tank baffle 12-1, a header 14 coupled to the tank 12 and allowing a tube 13 through which the refrigerant passes to be coupled thereto, and a gasket 15 sealing a coupling surface of the tank 12 and the header 14.

However, the header tank 11 of the related art has a problem that the gasket 15 located at an isolation zone 16 is pulled and deformed when the tank 12 and the header 14 are coupled. In detail, as shown on FIG. 2B, when the tank 12 and the header 14 are coupled by bending a bent member 14-2 formed at the edge of the header 14, the gasket 15 located in a zone A where a groove 14-1 formed at the header 14 and a coupling recess 14-3 to which the tank 12 is coupled are connected is pulled and deformed due to a coupling force of the tank 12 and the header 14, and thus the gasket 15 may escape from a designated position or damaged.

In addition, the gasket 15 used when the header tank 11 of the related art is coupled is designed such that an edge thereof fitted into the coupling recess 14-3 has a circular cross-sectional shape and a portion thereof sealing the tank baffle 12-1 has a quadrangular cross-sectional shape, and thus, a degree of compression of the gasket to correspond to an external force is varied to degrade assemblability. In other words, even the same material is different in compression degree to correspond to an external force depending on a shape thereof, and in particular, since a quadrangular cross-section has a degree of compression smaller than that of a circular cross-section, if the quadrangular cross-sectional portion and the circular cross-sectional portion are to be compressed to have the same compressibility, the quadrangular cross-sectional portion needs to have a larger compressive force than the circular cross-sectional portion, resulting in a problem that a unnecessary stronger force is required for assembling the tank 12 and the header 14.

DISCLOSURE

Technical Problem

An object of the present invention is to maximize sealing performance of a tank and a heater and improve reliability of a device by preventing deformation of a gasket.

Another object of the present invention is to provide a header tank capable of improving assemblability of a tank and a header, while maintaining sealing performance of a gasket through an appropriate compressive force.

Technical Solution

In one general aspect, a structure is provided in which a support surface inclined to be lowered in height toward an outer side is formed at a header portion in contact with a baffle sealing portion of a gasket, and the baffle sealing portion of the gasket has a shape corresponding to the support surface of the header, thereby preventing deformation of the gasket when a tank and the header of a header tank are coupled, and the gasket is allowed to have a uniform compressibility when the tank and the header are coupled, thereby ensuring sealing performance and assembling performance and preventing escape of the gasket.

Advantageous Effects

Through this solution, the integrated heat exchanger according to the present invention is advantageous in that it is possible to prevent deformation of the gasket when the tank and the header of the header tank are coupled.

In addition, the header tank of the present invention may solve the problem that the gasket of the coupling portion in which the baffle is located is compressed by more than a predetermined amount compared to the other coupling portion and the problem that the gasket is broken by a force of another direction or escapes from a designated position, thereby further improving sealing performance of the header tank.

In addition, a compressibility correction protrusion formed on one surface of the tank baffle facing the baffle sealing portion may make compressibility of a specific portion of the baffle sealing portion and compressibility of a peripheral sealing portion equal, thereby maximizing sealing performance of the header tank, and the compressibility of the baffle sealing portion at a position not in contact with the compressibility correction protrusion is controlled to be smaller than the compressibility of another portion of the sealing portion, thereby improving assemblability of the tank and the header.

In addition, an anti-escape protrusion fastened to the gasket is provided on both sides of the tank baffle to support the edge of the baffle sealing portion increased in width when the gasket is compressed and to prevent escape from a certain specified position.

In addition, an anti-torsion protrusion formed at the tank baffle is inserted into a coupling recess of the gasket to prevent torsion of the baffle sealing portion and prevent the gasket from escaping when the baffle sealing portion is compressed.

BEST MODE

Figure 1A:
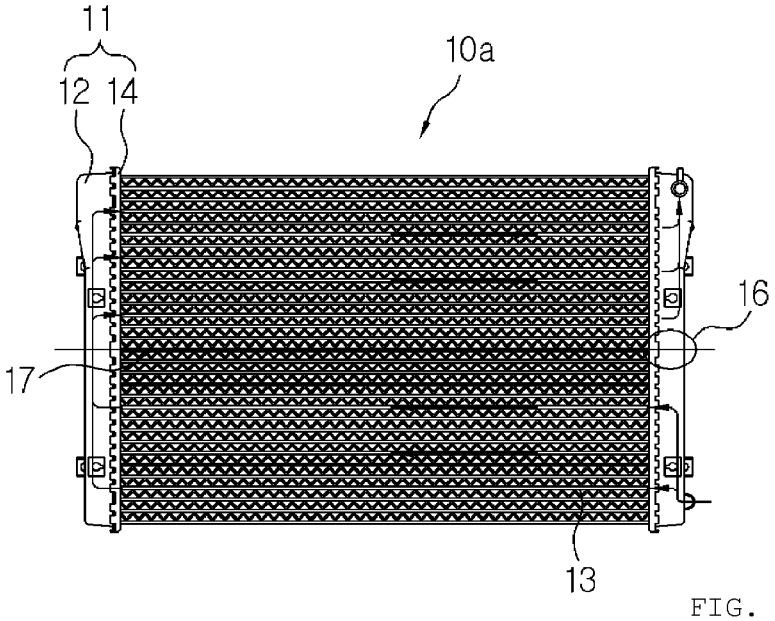
FIG. 1A is a plan view illustrating an example of a flow path separation radiator.
Figure 1B:
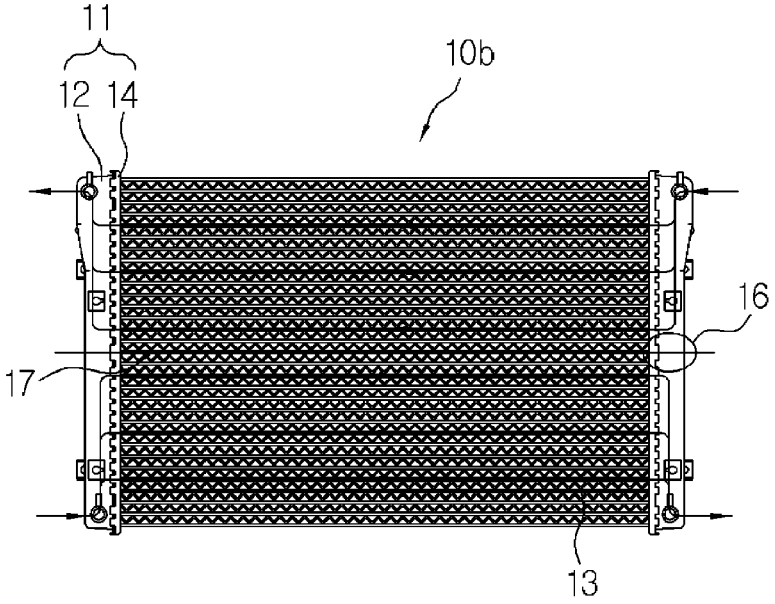
FIG. 1B is a plan view illustrating an example of a flow path separation radiator.

In an integrated heat exchanger of the present invention in which a header tank is attached to both ends of a plurality of heat exchange tubes, the header tank includes a tank 100 to which a first heat exchange medium and a second heat exchange medium are supplied, a header 200 connected to the heat exchange tube, and a gasket 300 inserted between the tank 100 and the header 200, wherein a tank baffle 110 is installed in the tank to partition the first heat exchange medium and the second heat exchange medium, the gasket 300 includes a baffle sealing portion 320 provided at a portion in contact with the tank baffle 110, the header 200 includes a support surface 230 provided at a portion in contact with the baffle sealing portion 320, and the support surface 230 includes an inclined surface 231 decreased in height toward an outer side of the header 200.

In addition, the support surface 230 has a planar seating surface 232 connected to a tube insertion hole formed at the header 200, and the inclined surface 231 gradually decreases in height from the seating surface 232.

In addition, the inclined surface 231 is provided on both ends of the seating surface 232 in a width direction of the seating surface 232.

In addition, the header 200 has a coupling recess 210 into which an end of the tank 100 is inserted, the gasket 300 includes a peripheral sealing portion 310 having a closed ring shape and inserted into the coupling recess 210 and the baffle sealing portion 320, and the baffle sealing portion 320 has a shape corresponding to the support surface 230 of the header 200.

In addition, the gasket 300 is provided such that compressibility of the peripheral sealing portion 310 is larger than compressibility of the baffle sealing portion 320.

In addition, the gasket 300 is provided such that the compressibility of the peripheral sealing portion 310 is equal to the compressibility of the baffle sealing portion 320.

In addition, the baffle sealing portion 320 has a uniform thickness.

In addition, the tank baffle 110 includes a plurality of baffle units 110A and a separation space 111 between the plurality of baffle units 110A.

In addition, a dummy tube to which a heat exchange medium is not supplied is inserted into the separation space 111.

In addition, the header 200 includes a bent member 240 pressing and fixing an end of the tank 100 inserted into the coupling recess 210.

In addition, the tank 100 has an anti-escape protrusion 114 fastened to the baffle sealing portion 320.

In addition, an anti-torsion protrusion 115 is provided on both sides of the tank baffle 110 in a thickness direction.

In addition, the tank 100 has a compressibility correction protrusion 113 provided at a position corresponding to the baffle sealing portion 320 during assembly.

In addition, the tank 100 has a compressibility correction recess 116 provided at a position corresponding to a connection portion of the peripheral sealing portion 310 and the baffle sealing portion 320 during assembly.

In addition, the support surface 230 has a trapezoidal cross section, and the baffle sealing portion 320 has a trapezoidal cross section corresponding to the support surface 230.

MODE FOR INVENTION

Hereinafter, an integrated heat exchanger according to the present invention will be described in detail with reference to the accompanying drawings.

Figure 3:
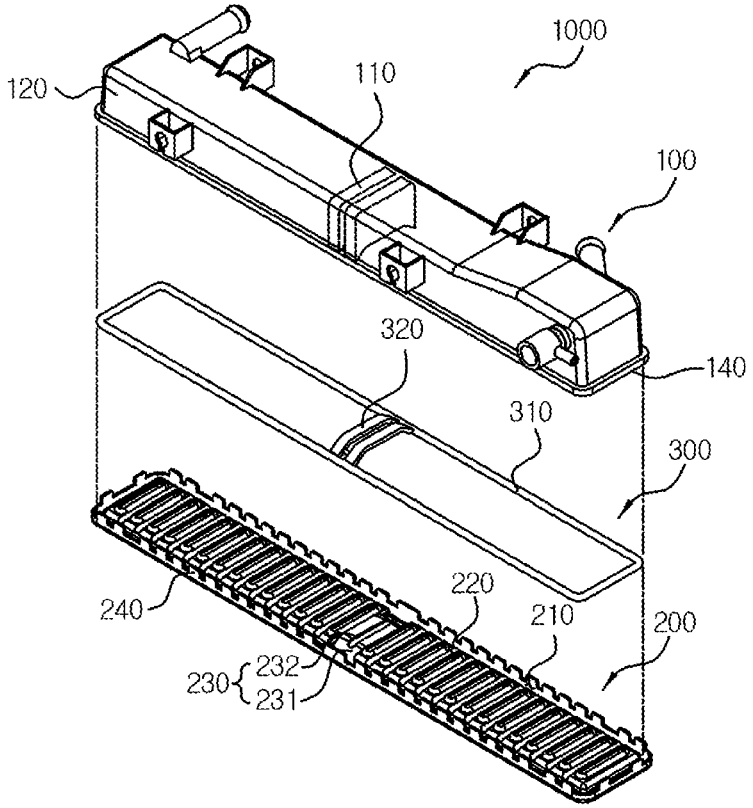
FIG. 3 is an exploded perspective view of a header tank of the present invention.

FIG. 3 is an exploded perspective view of a header tank 1000 of the integrated heat exchanger according to the present invention. Referring to FIG. 3, the header tank 1000 of the present invention includes a tank 100 in which a space is divided by the tank baffle 110 formed therein, a header 200 in which a coupling recess 210 is coupled to an edge 120 of the tank 100 and a plurality of tube insertion holes into which a tube is inserted are arranged in a length direction, and a gasket 300 inserted between the tank 100 and the header 200 and having a baffle sealing portion 320 provided at a position facing the tank baffle 110 of the tank 100.

Figure 4:
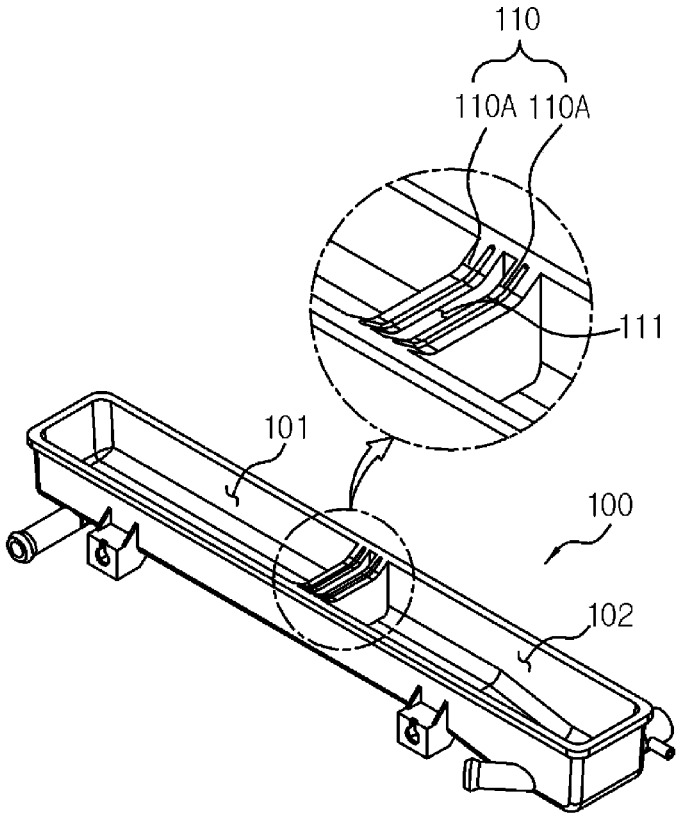
FIG. 4 is a perspective view of a tank of the present invention.

The tank baffle 110 dividing an internal space as shown in FIG. 4 is provided in the tank 100. The tank baffle 110 of the present invention is formed by a plurality of baffle units 110A and a separation space 111 between the plurality of baffle units 110A, and the space in the tank is divided into a first space 101 and a second space 102 by the tank baffle 110.

Figure 5:
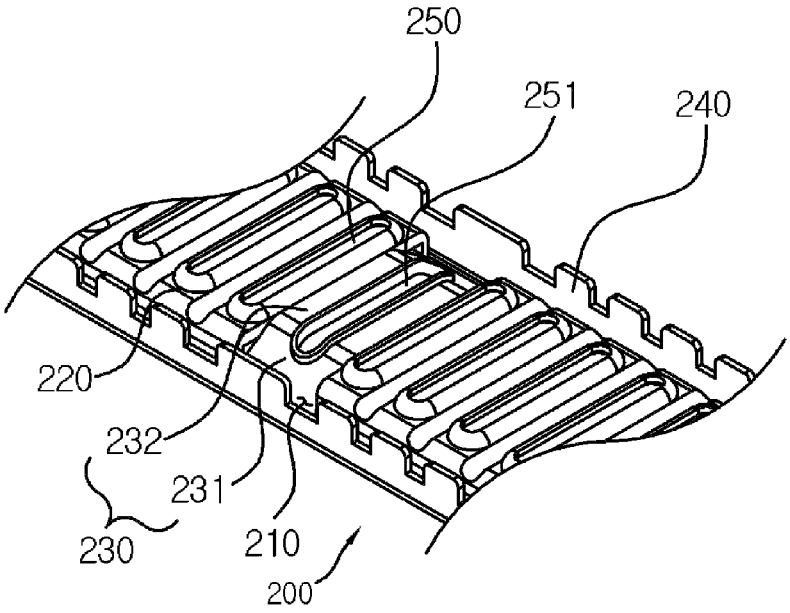
FIG. 5 is a partial perspective view illustrating a shape of a header of the present invention.

Meanwhile, a tube insertion hole 250 of the header 200 of the present invention may include a dummy tube insertion hole 251, to which a heat exchange medium is not supplied, and into which a dummy tube is inserted, in addition to a coolant tube to which the heat exchange medium is supplied as shown in FIG. 5. An end of the dummy tube in which the coolant does not flow may be fitted and fixed to the separation space 111 through a hollow provided on a support surface 230. Here, the dummy tube may prevent a first heat exchange medium and a second heat exchange medium having different temperatures flowing in radiators 10*a* and 10*b* from exchanging heat, and the dummy tube 17 may be filled with an insulating material to further increase such performance.

The header 200 of the present invention includes a groove 220 between the tube insertion holes 250 to which the coolant tube is coupled and a plurality of grooves including the support surface 230 formed on both sides of the dummy tube insertion hole 251 into which the dummy tube is inserted, and the baffle sealing portion 320 of the gasket is in contact with the support surface 230. Here, a seating surface 232 supporting a central portion of the baffle sealing portion 320 of the gasket is provided at the portion of the support surface 230 in contact with the baffle sealing portion 320 of the gasket, and an inclined surface 231 gradually decreasing in height toward the coupling recess 210 positioned on an outer side of the header 200 in a width direction is provided on both sides of the seating surface 232. Accordingly, the peripheral sealing portion 310 of the gasket 300 is fitted into the coupling recess 210 of the header 200, and the baffle sealing portion 320 is coupled in contact with the support surface 230.

Preferably, the seating surface 232 is formed as a plane, the inclined surface 231 is preferably formed as a plane leading to the coupling groove 210 from both ends of the seating surface 232, and the support surface 230 is preferably formed such that a cross section thereof has a trapezoidal shape on the whole. In addition, a lower surface of the baffle sealing portion 320 has a shape corresponding to the support surface 230 and preferably includes a gasket inclined surface 321 and a gasket connection surface 322 spaced apart from the seating surface 232 and the inclined surface 231 by a predetermined interval.

Figure 2A:
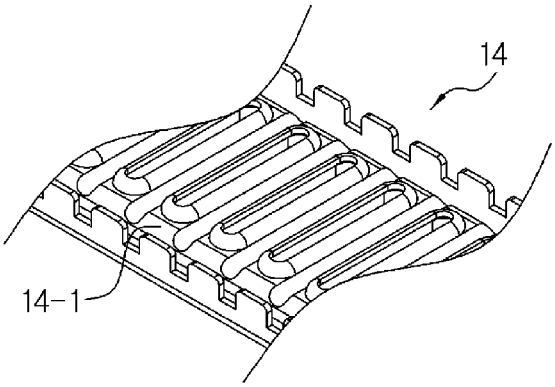
FIG. 2A is a partial perspective view illustrating a shape of a header of the related art and FIG. 2B is a partially enlarged cross-sectional view illustrating a problem when a header tank is coupled.
Figure 2B:
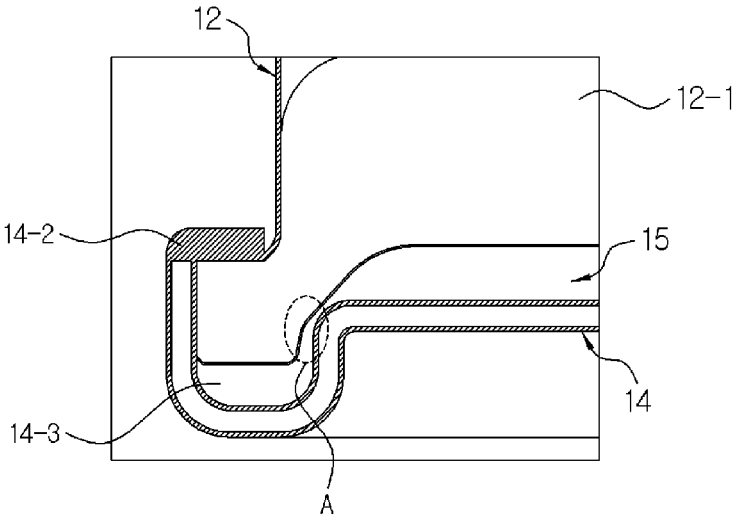
Figure 7:
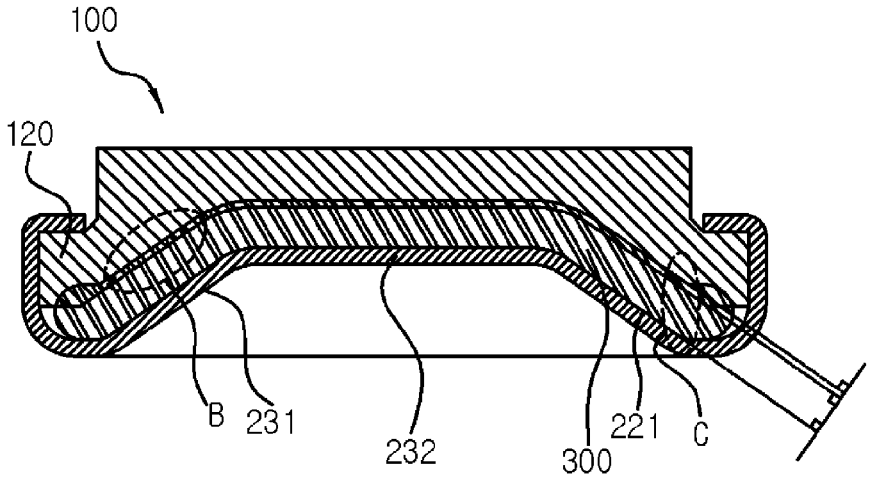
FIG. 7 is a cross-sectional view illustrating a state where a header, a gasket, and a tank are coupled at a tank baffle portion of the present invention.

As described above, if the portion where the tank baffle 110 is positioned is formed to have such a shape as the groove 220 between the tube insertion holes 250 to which the coolant tube is coupled, a connection surface of the coupling recess and both ends in the width direction has a steep slope as shown on FIG. 2B, causing a problem that both sides of the gasket 15 in the width direction are pulled or the portion A is excessively pressed to be deformed. However, in the header 200 of the present invention, as shown in FIG. 7, since the support surface 230 having a predetermined area is formed at the portion where the tank baffle 110 is positioned and the inclined surface 231 are formed on both sides of the support surface 230 to have a gentle slope on the outer side of the header 200 in the width direction, whereby the gasket 300 may be constantly compressed in portions B and C and uniformly compressed even at the inclined portion, thus eliminating a problem such as excessive pressing deformation or the like at a specific portion, thus eliminating a problem that the gasket 300 is pulled even when the tank 100 and the header 200 are coupled, and thus improving sealing performance of the header tank. Preferably, the lower surface of the tank baffle 110 is formed to have a shape corresponding to the inclined surface 221 of the header 200 so that a lower extending line and an upper extending line of the gasket 300 are parallel to each other at the inclined portion as shown in FIG. 7. In detail, since the baffle sealing portion 320 is deformed to correspond to strength and direction of an applied force and a thickness of the baffle sealing portion 320, the sloped surface 231, the sealing surface 232 connecting a pair of the inclined surfaces 231 spaced apart from each other, the gasket inclined surface 321 and the gasket connection surface 322 of the baffle sealing portion 320 in contact therewith are formed to have a predetermined shape and a predetermined interval so that the same force is applied to each portion of the baffle sealing portion 320, and in addition, the gasket inclined surface 321 has the same slope as that of the inclined surface 231 so that a force having the same directionality is applied to the gasket inclined surface 321, and thus, each portion of the baffle sealing portion 320 may have the same compressive force when the same external force is applied to the baffle sealing portion 320.

In the present invention, in order to increase the sealing performance of the gasket 300 when the tank 100 and the header 200 are coupled, the baffle sealing portion 320 of the gasket 300 and the peripheral sealing portion 310 compressed as the tank 100 and the header 200 are coupled may have different cross-sectional shapes. In an embodiment, the peripheral sealing portion 310 of the gasket 300 fitted into the coupling recess 210 of the header to seal the coupling recess 210 of the edge portion 120 of the tank 100 may have a circular cross-sectional shape, while the baffle sealing portion 320 sealing the space between the tank baffle 110 and the support surface 230 may have a quadrangular cross-sectional shape so that the baffle sealing portion 320 is prevented from being pressed by the support surface 230 and the tank baffle 110 and from escaping or from being distorted from a designated position. Here, if compressibility of the peripheral sealing portion 310 and compressibility of the baffle sealing portion 320 are different when the tank 100 and the header 200 are coupled, a refrigerant may be leaked to a specific portion having low compressibility, and thus, it is preferred for each portion of the gasket 300 blocking the refrigerant to have the same compressibility. If, however, the baffle sealing portion 320 of the gasket 300 having the quadrangular cross-sectional shape and the peripheral sealing portion 310 of the gasket having the circular cross-sectional shape have the same compressibility, compressive stress of the baffle sealing portion 320, compared with the peripheral sealing portion 310 which is compressed and deformed in a state of being fitted in the coupling recess 210, may significantly work to make it difficult to assemble the tank 100 and the header 200, and thus, preferably, the compressibility of the peripheral sealing portion 310 is greater than the compressibility of the baffle sealing portion 320.

Figure 6A:
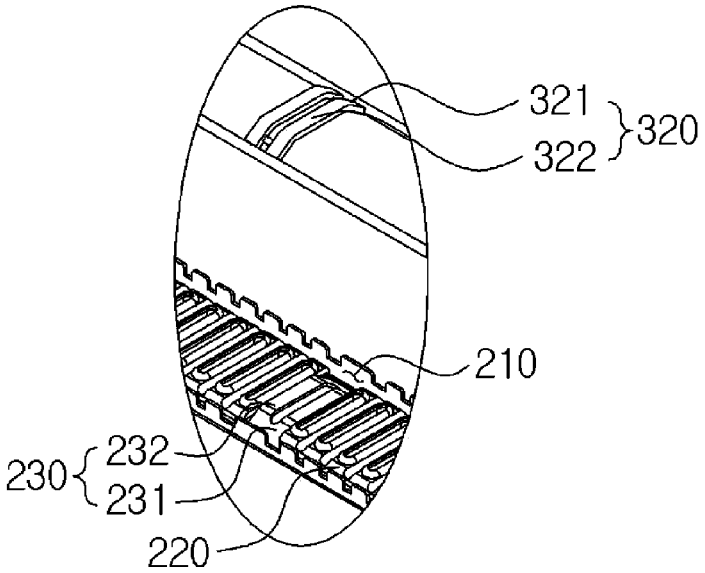
FIG. 6A is a partial perspective view before a header and a gasket of the present invention are coupled.
Figure 6B:
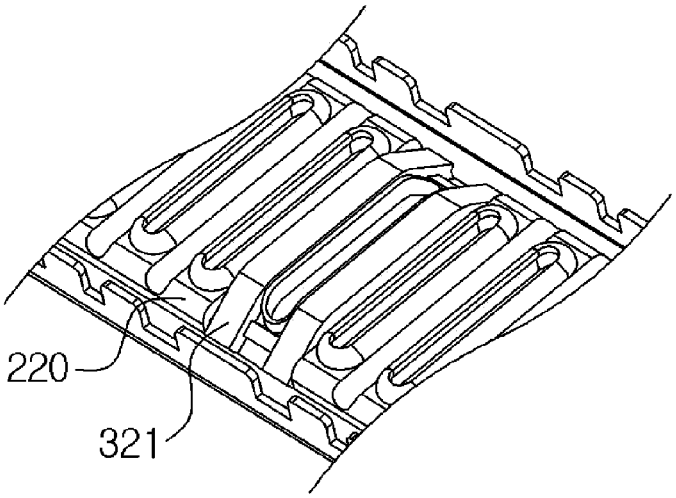
FIG. 6B is a partial perspective view after the header and the gasket of the present invention are coupled.

Meanwhile, if a compressive force of the baffle sealing portion 320 is increased as a force is applied to the baffle sealing portion 320 during assembly of the header tank 1000, the baffle sealing portion 320 may escape from the support surface 230. Thus, as shown on FIG. 6A, both side edges of the groove 220 are formed at a position higher than the inclined surface 231 of the support surface 230, and preferably, as shown on FIG. 6B, both side edges of the groove 220 are configured at a position higher than the gasket inclined surface 321 of the assembled baffle sealing portion 320 so that the groove 220 adjacent to the support surface 230 limits displacement of the baffle sealing portion 2320 positioned on the support surface 230 when the baffle sealing portion 320 is positioned on the support surface 230.

Figure 8:
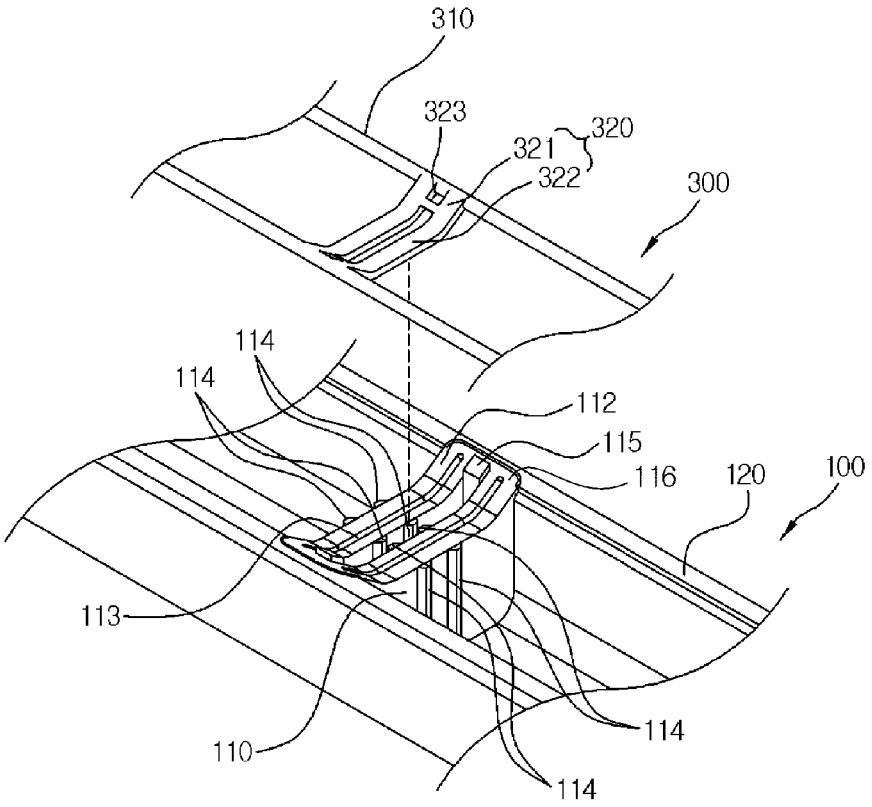
FIG. 8 is a partial perspective view before the header and gasket of the present invention are coupled.

FIG. 8 is a partial perspective view showing another exemplary embodiment of the tank 100 of the present invention. Referring to FIG. 8, a compressibility correction protrusion 113 for increasing a compressive strain of the baffle sealing portion 320 during assembly of the header tank 1000 is provided on one surface of the tank baffle 110 facing the baffle sealing portion 320. Here, the compressibility correction protrusion 113 may extend over the seating surface 232 and the inclined surface 21 of the support surface 230. Preferably, the compressibility correction protrusion 113 is provided at a portion corresponding to a central region H of the baffle sealing portion 320 of FIG. during assembly so that the central region H of the baffle sealing portion 320 in contact with the compressibility correction protrusion 113 may have the same compressive force as that of the peripheral sealing portion 310 to improve sealability.

Meanwhile, a compressibility correction recess 116 may be formed with a predetermined depth with respect to the edge portion 120 at a position corresponding to a connection portion of the peripheral sealing portion 310 and the baffle sealing portion 320 at an end portion of a tank inclined surface 112. By forming the compressibility correction recess 116 at the position corresponding to the connection portion of the peripheral sealing portion 310 and the baffle sealing portion 320, each point of the gasket 300 may have the same compressive force, thus improving sealability.

Figure 9:
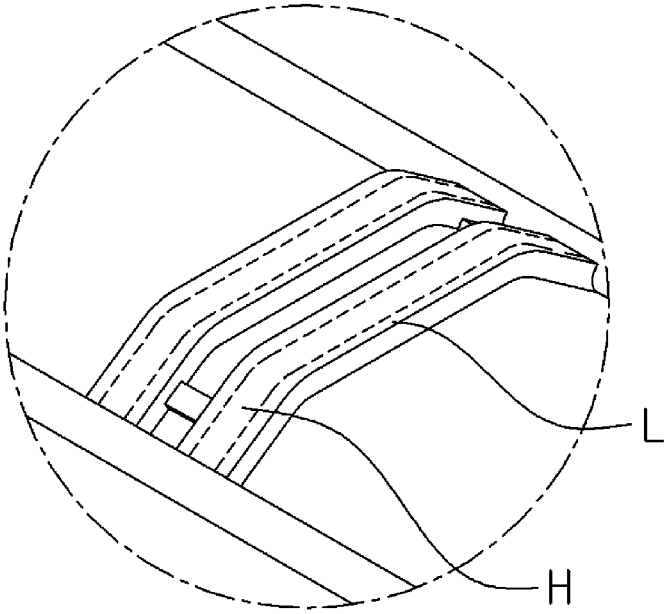
FIG. 9 is a partially enlarged perspective view of a gasket illustrating gasket deformation when a header and a tank are coupled.

In addition, as shown in FIG. 9, an edge region L positioned on both sides of the central region H of the baffle sealing portion 320 may have a compressibility lower by about 15 to 25 percent than the peripheral sealing portion 310 to improve sealing performance of the gasket 300 and assemblability of the tank 100 and the header 200.

Meanwhile, in the present invention, an anti-escape protrusion 114 may be provided on an outer surface of the tank baffle 110 to secure an appropriate contact area although the baffle sealing portion 320 escapes from a designated position due to a compressive force during assembly, and preferably, the anti-escape protrusion 114 may be provided in plurality on both surfaces of the baffle unit 110A. The anti-escape protrusion 114 may increase a support area so that the baffle sealing portion of the gasket 300 may not completely escape from the tank baffle 110 although the baffle sealing portion 320 escapes from the certain designated position to correspond to a compressed force during assembly of the tank 100 and the header 200.

In more detail, when the tank 100 and the header 200 are coupled to each other, if forces for coupling the tank 100 and the header 200 are accurately applied to an upper side and a lower side of the baffle sealing portion 320 in directions corresponding to each other, the baffle sealing portion 320 may be compressed and deformed in a state of being fixed to the certain designated position. However, since manufacturing tolerance occurs in manufacturing the tank 100, the header 200, and the gasket 300, it may be difficult to apply a force having accurate directionality to the baffle sealing portion 320, and in addition, a force having specific directionality may be applied to the baffle sealing portion 320 during assembly of the tank 100 and the header 200 to cause the baffle sealing portion 320 to escape from the certain designated position. In this case, however, if the support area of the tank baffle 110 is increased through the anti-escape protrusion 114, the baffle sealing portion 320 may be prevented from escaping.

In addition, when the header 200 and the tank 100 are coupled, the edge region L of the baffle sealing portion 320 is gradually increased as shown in FIG. 9 as the baffle sealing portion 320 is compressed in contact with the tank baffle 110, and here, an end of the baffle sealing portion 320 in a thickness direction may escape outward, rather than coming into contact with the tank baffle 110. Therefore, the anti-escape protrusion 114 is provided on both sides of the tank baffle 110 to support the outermost edge region L of the baffle sealing portion 320 even when the edge region L is gradually increased as the baffle sealing portion 320 is compressed. Preferably, the anti-escape protrusion 114 has the same height as the tank baffle 110.

In addition, in the present invention, an anti-torsion protrusion 115 may be provided on both sides of the tank 100 in the thickness direction in order to prevent the peripheral sealing portion 310 from being moved by pressure when the header 200 and the tank 100 are coupled. The anti-torsion protrusion 115 is formed at both ends of the tank baffle 110 as shown in FIG. 8 and coupled to a coupling hole 323 formed in the gasket 300 to prevent movement of the peripheral sealing portion 310 or escape of the gasket 300 and to serve as an assembly guide during assembly.

The present invention should not be construed as being limited to the above-mentioned exemplary embodiment. The present invention may be applied to various fields and may be variously modified by those skilled in the art without departing from the scope of the present invention claimed in the claims. Therefore, it is obvious to those skilled in the art that these alterations and modifications fall in the scope of the present invention.

DETAILED DESCRIPTION OF MAIN ELEMENTS

1000: header tank
100: tank
110: tank baffle
111: separation space
112: tank inclined surface
113: compressibility correction protrusion
114: anti-release protrusion
115: anti-torsion protrusion
116: compressibility correction recess
120: edge portion
200: header
210: coupling recess
220: groove
230: support surface
231: inclined surface
232: seating surface
240: bent member
250: tube insertion hole
251: dummy tube insertion hole
300: gasket
310: peripheral sealing portion
320: baffle sealing portion
321: gasket inclined surface
322: gasket connection surface
323: coupling hole

INDUSTRIAL APPLICABILITY

The present invention relates to a heat exchanger which has industrial applicability.

The invention claimed is:

1. An integrated heat exchanger comprising: a plurality of heat exchange tubes having two ends, a header tank attached to both ends of the plurality of heat exchange tubes, wherein the header tank comprises 1) a tank to which a first heat exchange medium and a second heat exchange medium are supplied, 2) a header connected to the plurality heat exchange tubes, and 3) a gasket inserted between the tank and the header, a tank baffle installed in the tank to partition a first heat exchange medium space and a second heat exchange medium space, wherein the gasket comprises a baffle sealing portion provided at a portion of the gasket in contact with the tank baffle and a peripheral sealing portion having a closed ring shape with a circular cross-sectional shape, wherein the peripheral sealing portion is inserted into a coupling recess, wherein the header comprises a support surface provided at a portion in contact with the baffle sealing portion and the coupling recess into which an end of the tank is inserted, wherein the support surface comprises a planar seating surface and an inclined surface formed as a plane leading to the coupling groove from both ends of the seating surface, wherein the inclined surface decreases in height downward from a height of the planar seating surface toward an outer side of the header, wherein a length direction is defined as a direction where the plurality of heat exchange tubes are arranged, and a width direction is defined as a direction perpendicular to the length direction, wherein the baffle sealing portion comprises a quadrangular cross-sectional shape corresponding to the support surface of the header such that the peripheral sealing portion and the baffle sealing portion are compressed between the tank and the header;

wherein the tank has an anti-escape protrusion fastened to the baffle sealing portion;

wherein an anti-torsion protrusion is provided on both sides of the tank baffle; and wherein the tank has a compressibility correction protrusion provided at a position corresponding to the baffle sealing portion.

2. The integrated heat exchanger of claim 1, wherein the planar seating surface is connected to a tube insertion hole formed at the header.

3. The integrated heat exchanger of claim 2, wherein the inclined surface is provided on both ends of the seating surface in the width direction.

4. The integrated heat exchanger of claim 3, wherein the gasket is provided such that the compressibility of the peripheral sealing portion is greater than the compressibility of the baffle sealing.

5. The integrated heat exchanger of claim 2, wherein the gasket is provided such that the compressibility of the peripheral sealing portion is greater than the compressibility of the baffle sealing portion.

6. The integrated heat exchanger of claim 1, wherein the gasket is provided such that the compressibility of the peripheral sealing portion is greater than the compressibility of the baffle sealing portion.

7. The integrated heat exchanger of claim 6, wherein the baffle sealing portion has a uniform thickness.

8. The integrated heat exchanger of claim 1, wherein the tank baffle includes a plurality of baffle units and a separation space between the plurality of baffle units.

9. The integrated heat exchanger of claim 8, wherein a dummy tube not filled with the first heat exchange medium or the second heat exchange medium is inserted into the separation space.

10. The integrated heat exchanger of claim 1, wherein the header includes a bent member pressing and fixing the end of the tank inserted into the coupling recess.

11. The integrated heat exchanger of claim 1, wherein the tank has a compressibility correction recess provided at a position corresponding to a connection portion of the peripheral sealing portion and the baffle sealing portion.

12. The integrated heat exchanger of claim 1, wherein the quadrangular cross-sectional shape has a trapezoidal cross section.

* * * * *